United States Patent [19]

McFarlane

[11] Patent Number: 4,630,866

[45] Date of Patent: Dec. 23, 1986

[54] SEAT RECLINE UNIT

[75] Inventor: Arthur H. McFarlane, Basildon, England

[73] Assignee: Morse Controls Limited, Basildon, England

[21] Appl. No.: 710,392

[22] Filed: Mar. 11, 1985

[30] Foreign Application Priority Data

Mar. 14, 1984 [GB] United Kingdom ..... 8406697

[51] Int. Cl.[4] ..... B60N 1/02; F16H 29/20; F03G 1/00

[52] U.S. Cl. ..... 297/361; 74/89.15; 74/424.8 R; 185/39; 297/354; 297/362

[58] Field of Search ..... 297/361, 362, 354, 355; 267/73, 58, 59, 62, 155, 156; 74/424.8 R, 424.8 NA, 89.15; 185/37, 39

[56] References Cited

U.S. PATENT DOCUMENTS

| | | | |
|---|---|---|---|
| 895,492 | 8/1908 | Neate | 267/62 |
| 1,895,948 | 1/1933 | Van Den Broek | 267/59 X |
| 2,175,516 | 10/1939 | Bugatti | 267/59 |
| 2,579,305 | 12/1951 | Cushman | 297/361 |
| 2,899,193 | 8/1959 | Foster | 185/37 X |
| 3,151,704 | 10/1964 | Clarke | 185/37 |
| 3,194,344 | 7/1965 | Sindlinger | 185/39 |
| 3,246,868 | 4/1966 | Martens et al. | 297/361 X |
| 3,479,890 | 11/1969 | Howell | 74/89.15 |
| 4,000,664 | 1/1977 | Christensen | 74/424.8 R |
| 4,186,615 | 2/1980 | Adams | 74/424.8 R |
| 4,459,867 | 7/1984 | Jones | 74/89.15 |

FOREIGN PATENT DOCUMENTS

| | | | |
|---|---|---|---|
| 1498802 | 9/1967 | France | 297/362 |

*Primary Examiner*—Kenneth J. Dorner
*Assistant Examiner*—Mark W. Binder
*Attorney, Agent, or Firm*—James C. Wray

[57] ABSTRACT

A recline unit (6) for controlling the recline angle of the back rest (2) of a seat (1) is interposed as a strut between the back rest (2) and the seat base (3). The recline unit (6) has a recirculating ball screw (7) and nut (8) of which the former is mounted to the back rest (2) so as to be restrained against rotation and of which the latter is mounted to the seat base (3) so as to be restrained from moving axially but to be free to rotate. Manual pressure applied to the back rest (2) to incline it will move the ball screw (7) axially and cause the nut (8) to rotate. A locking mechanism (25) is provided to lock the nut (8) against rotation when the back rest (2) is in the desired reclined attitude and so prevent further axial movement of the ball screw (7). The occupant of the seat (1) can unlock the locking mechanism (25) by operating a button (40) which acts through a pull cable (37) on the locking mechanism (25). A back rest return device (41) includes a constant torque torsion spring (43) which, when manual pressure is removed from the back rest (2) and when the locking mechansim (25) is unlocked, will reversely rotate the nut (8) thereby to axially move the ball screw (7) reversely and so return the back rest (2) towards its upright attitude, the torsion spring (43) being strained when the nut (8) is rotated during reclining of the back rest (2).

17 Claims, 6 Drawing Figures

SEAT RECLINE UNIT

This invention relates to a recline unit for controlling the recline angle of the back rest of a seat, particularly, but not exclusively, an aircraft seat.

According to the invention, such a recline unit comprises a cooperating screw and nut means, mounting means for mounting the cooperating screw and nut means between the back rest and a fixed part of the seat so that the recline unit is interposed as a strut therebetween, the cooperating screw and nut means when so mounted being responsive to the back rest being inclined such that relative axial movement occurs between the cooperating screw and nut means so varying the length of the strut in accordance with the inclination of the back rest with attendant relative rotational movement between the cooperating screw and nut means, and torsion spring means strained in response to the cooperating screw and nut means making said relative rotational movement and operative to effect reverse relative rotational movement between the cooperating screw and nut means with attendant reverse relative axial movement thereof to cause opposite variation in the length of the strut and so return the back rest to a lesser inclination.

In a preferred embodiment of the invention a locking means is also provided which is operable by an occupant of the seat to lock the cooperating screw and nut means against relative rotation when the back rest is in the required attitude and which can be unlocked either to allow the torsion spring means to reverse the relative rotation of the cooperating screw and nut means and so return the back rest towards an upright attitude or to allow the occupant to recline the back rest by leaning upon it.

Desirably, the cooperating screw and nut means is of the recirculating ball type, the torsion spring means is a constant torque spring, an the locking means is such as to be remotely operated via a flexible cable by a control conveniently situated for operation by the seat occupant.

In order that the invention may be well understood the preferred embodiment and modifications thereof, given by way of example, will now be described with reference to the accompanying drawings, in which.

In the various figures, like numerals denote like parts.

Figure 1:
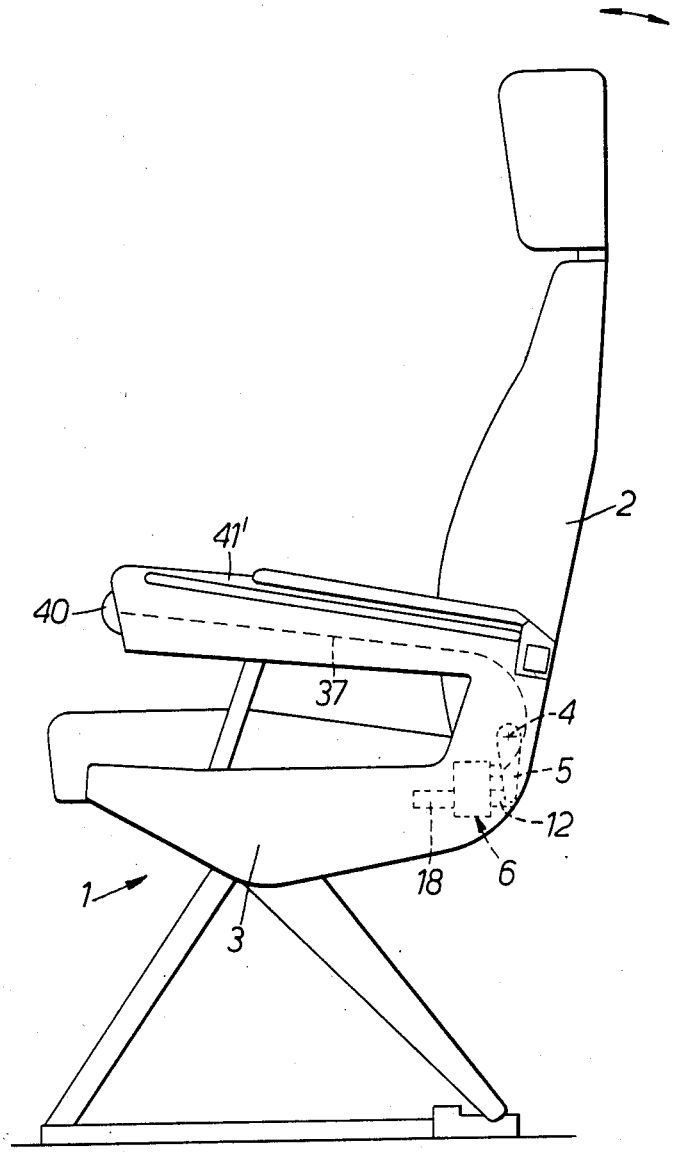
FIG. 1 is a pictorial view of a seat fitted with a recline unit for the back rest of the seat.
Figure 2:
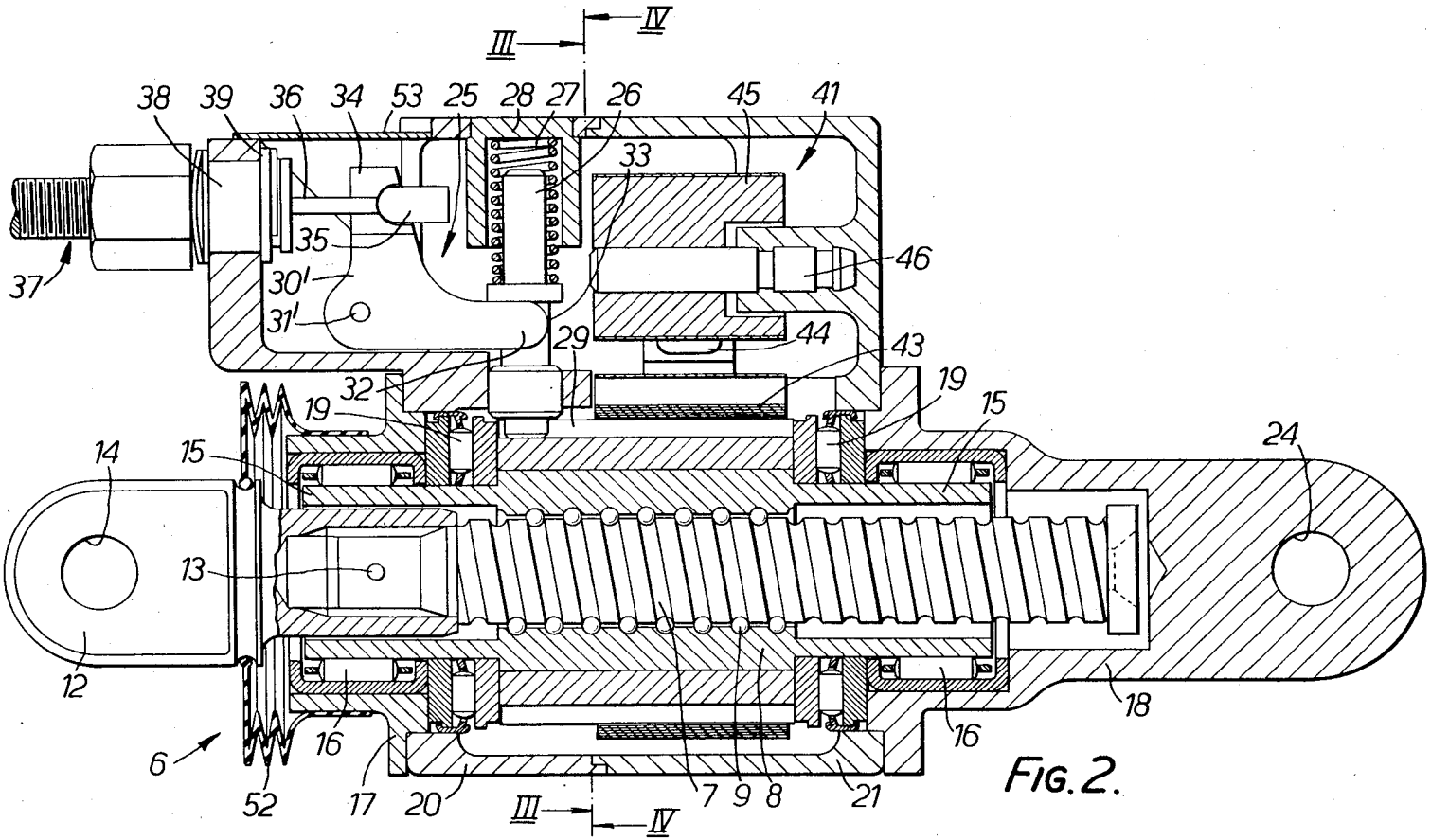
FIG. 2 is a longitudinal sectional elevation of the same recline unit.
Figure 3:
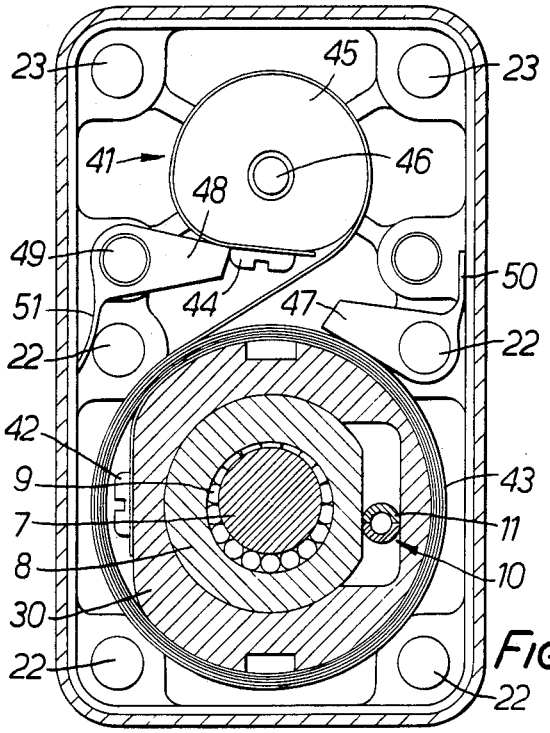
FIG. 3 is a transverse section taken along the line III—III of FIG. 2.
Figure 4:
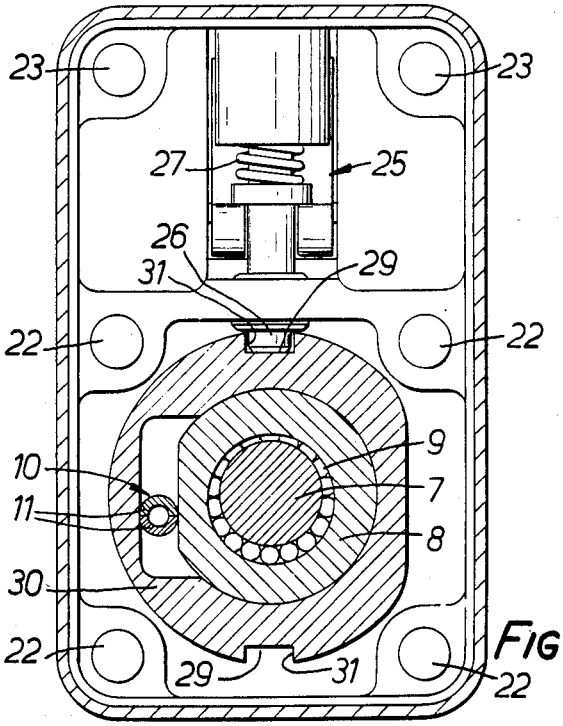
FIG. 4 is a transverse section taken along the line IV—IV of FIG. 2.

Referring first to FIG. 1, a seat 1 has its back rest 2 pivotally mounted at its lower part on the seat base 3 so that it can be swung about a transverse axis 4 between upright and reclined attitudes. A lever 5 fast with the lower part of the back rest 2 extends downwardly from the pivot axis 4, and a seat recline unit 6 better shown in FIGS. 2 to 4 is interposed as a strut between the lower end of the lever and the seat base 3.

The length of the strut formed by the seat recline unit 6 will vary with the inclination of the back rest 2, and the strut can be locked by the occupant of the seat 1 at a length commensurate with a desired attitude of the back rest to maintain the back rest in that attitude. Therefore, different angles of seat back recline are related to different adjustable lengths of the recline unit 6.

When the occupant unlocks the recline unit 6 so that its length can be varied, the inclination of the back rest 2 can be increased by the occupant applying a backward pressure to it which causes the lever 5 to decrease the length of the recline unit until such time as the occupant again locks the recline unit against length variation. When the back rest 2 is to be returned towards the vertical, the occupant removes his back pressure from the back rest and unlocks the recline unit at which time means in the unit function to increase its length and so apply a turning force via the lever 5 to tilt the back rest forwards.

The length of the recline unit 6 is determined by the relative axial positions of a cooperating screw 7 and nut 8, the screw being of the recirculating ball type, the balls 9 recirculating through a ball return tube 10 which may consist of two half tubes 11 and which is located in the nut 8.

An end fitting 12 is screwthreaded on to the recirculating ball screw 7 and is locked to it by a pin 13. The end fitting 12 is adapted to be mounted at its aperture 14 to the lever 5 secured to the lower part of the back rest 2. When the end fitting 12 is so mounted, the screw 7 is restrained against rotational movement.

The nut 8 at its opposite ends has integral tubular extensions 15 and is supported thereat by a pair of needle roller bearings 16 which are respectively mounted in bearing housings 17,18. Axially inwardly adjacent the bearings 16, the nut extensions 15 are further supported by a pair of needle thrust bearings 19 which are respectively mounted in body mouldings 20,21. The bearing housings 17,18 are secured in the body mouldings 20,21 by four bolts 22, and the top parts of the body mouldings are secured together by two further bolts 23, thereby resulting in a unitary housing structure.

The nut 8 can rotate by means of the needle roller bearings 16 in the housing structure, but is made axially fast therein by the needle thrust bearings 19 and hence is axially fast with respect to the bearing housing 18. Moreover, the bearing housing 18 is shaped as an end fitting and is adapted to be mounted at its aperture 24 to the seat base 3. Therefore, in use, the bearing housing or end fitting 18 is restrained against axial movement and so also is the nut 8.

When the back rest 2 is reclined, the lever 5 will apply an end load to the end fitting 12 which will move axially into the respective nut tubular extension 15 which is fashioned to accomodate it, the nut 8 itself remaining axially stationary with the unitary housing structure. Thereby, the length of the recline unit 6, which is governed by the spacing between the centres of the apertures 14,24 in the end fittings 12,18, is shortened. The rotationally fast screw 7 will move axially with the end fitting 12 and so cause the nut 8 to rotate and the balls 9 to recirculate in the ball return tube 10.

A locking mechanism 25 is provided to lock the nut 8 against further rotation when the back rest 2 is in the desired reclined attitude, this restraining further axial inward movement of the screw 7 into the nut and so setting the length of the recline unit 6, acting as a strut between the seat base 3 and the back rest lever 5, appropriate to that angle of the back rest.

The locking mechanism 25 includes a locking pin 26 which is axially guided for movement in a direction perpendicular to the axis of the screw 7 in the body moulding 20, and is biased downwardly by a compression coil spring 27 seated in a spring cup 28 made integral with the top of that body moulding. The pin 26 can engage in either of two diametrically opposed slots 29 formed in the periphery of a drive output roller 30 which is mounted on and made rotationally fast with the nut 8. When the pin 26 is spring loaded into a slot 29 it will engage against an end shoulder 31 of the slot as the nut 8 rotates under the influence of the screw 7 moving axially into it, and so will stop the nut from rotating further in the same sense.

As will be realized, the reason for having more than one locking slot 29 is to reduce the length increments of the recline unit 6 between locking positions and so give twice the number of finite angular attitudes in which the back rest 2 can be locked. The slots 29 may be in one end of the drive output roller 30 only since the nut 8 and that roller do not move axially.

The locking pin 26 can be radially withdrawn from the locking slot 29 against the bias of the spring 27 by means of a bell crank lever 30' which is mounted for pivotal movement in the unitary housing structure by a pin 31' fast with the body moulding 20. One arm 32 of the lever 30' engages a groove 33 in the locking pin 26, and the other arm 34 is engaged by the enlarged end 35 of the core 36 of a flexible pull cable generally referenced 37. The conduit 38 of the cable 37 is mounted in the body moulding 20 and secured thereto by a circlip 39.

A button 40 which may be placed at a convenient position on the seat base 3 or, as shown in FIG. 1, on an armrest 41', is coupled by any suitable means to the core 36 of the cable 37 which is led from the recline unit 6 through the armrest. Depression of the button 40 by the seat occupant is arranged to exert a pulling action on the core 36 so pivoting the lever 30' in a sense to cause its arm 32 to urge the locking pin 26 out of the locking slot 29 at which time the back rest 2 can be further reclined in the manner already described or returned towards the vertical by means now to be described.

A back rest return device 41 includes the aforementioned drive output roller 30 to which is fixed by a screw 42 one end of a torsion spring 43 which is desirably of the constant torque type. The other end of the torsion spring 43 is fixed by a screw 44 to a spring storage bobbin 45 which is rotatably mounted within the unitary housing structure on a pin 46 secured in the body moulding 21. When the back rest 2 is reclined, the attendant rotation of the nut 8 and hence the drive output roller 30 will draw the torsion spring 43 from the bobbin 45 and the torsion spring will wrap around the roller 30 as shown in FIG. 3. The torsion spring 43 is thus stressed, and hence applies a torque load to the nut 8 acting in opposition to the end load in the recirculating ball screw 7. The correct choice of spring torque, therefore gives the necessary force to move the back rest 2 from the reclined towards the upright attitude.

When, then, the seat occupant wishes to move the back rest 2 to a less reclined attitude or to return the back rest to the uprigh attitude, he removes his back pressure from the back rest and depresses the button 40 to unlock the locking pin 26 from the locking slot 29 in the drive output roller 30, whereupon the stressed torsion spring 43 will return around the storage bobbin 45 and rotate the roller 30 and hence the nut 8 in the opposite sense from previously thus driving the recirculating ball screw 7 axially outwardly to increase the effective length of the recline unit 6. To lock the recline unit 6 at its increased length commensurate with the desired attitude of the back rest 2, the occupant releases the button 40 thereby enabling the spring 27 to urge the locking pin 26 downwardly to engage the end shoulder 31 of the respective locking slot 29 so again restraining the nut 8 from rotation.

A pawl 47 pivotally mounted on one of the bolts 22 and another pawl 48 pivotally mounted on a pin 49 secured in the body moulding 21 have tails 50,51 respectively, which act as springs to engage the pawls 47,48 respectively with the screws 42,44 at the extremes of travel of the torsion spring 43 preventing further rotation of the drive output roller 30 and the storage bobbin 45.

As shown in FIGS. 3 and 4, the locking slots 29 are diametrically opposite grooves each with opposite straight sides and having a width between those sides just sufficient to enable the slot to accomodate the locking pin 26, in which event the slot would lock to prevent rotation of the nut 8 in both senses of rotation. Whilst such a construction is satisfactory in normal operation, it does not, of course, should there be a failure in the cable enable the back rest 2 to be forced manually back into the upright attitude.

Figure 5:
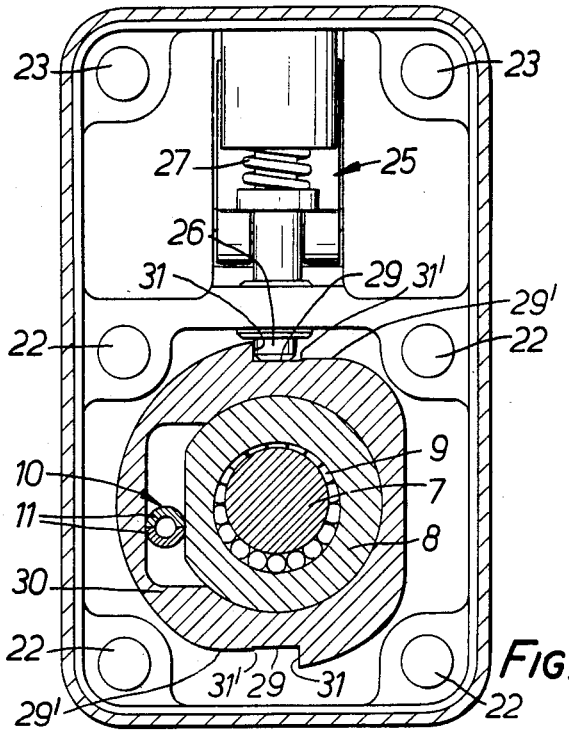
FIG. 5 is a transverse section, similar to FIG. 4, of a modified recline unit.

In the alternative embodiment shown in FIG. 5, each locking slot 29 is straight, at its end shoulder 31, on one side but is cut-away at 29' on the other. The reason for adopting this configuraton is to allow the back rest 2 to be pushed manually into the upright attitude from the reclined attitude in the event of cable failure from the button 40. By cutting away one side of the slot, when an extending load is applied to the recline unit 6 as would be the case if the back rest 2 were being forcibly put into the upright attitude, the nut 8 will be forced to rotate which can occur because the locking pin 26 is not constrained by the slot 29 in one sense of rotation. In the other sense of rotation, the slot 29 still acts as a lock, as described, to prevent movement when the occupant leans back against the back rest 2. The cut-away side 29' leaves the locking slot 29 with a small shoulder 31' sufficient to act as a restraint against the returning force of the spring 43 but not against the additional force created by the manual load required to force the seat to the upright position.

A flexible bellows 52 is mounted between the bearing housing 17 and the end fitting 12 to prevent ingress of undesirable extraneous matter such as dust into the recline unit 6, and a spring clip 53 is mounted on the body moulding 20 for the same purpose.

When the recline unit 6 is mounted on the seat 1 as described, its line of action lies below the pivot axis 4 of the back rest 2. As will be seen from FIG. 3, the torsion spring 43 is led off the storage bobbin 45 in a clockwise sense and on to the drive output roller 30 in an anticlockwise sense.

Figure 6:
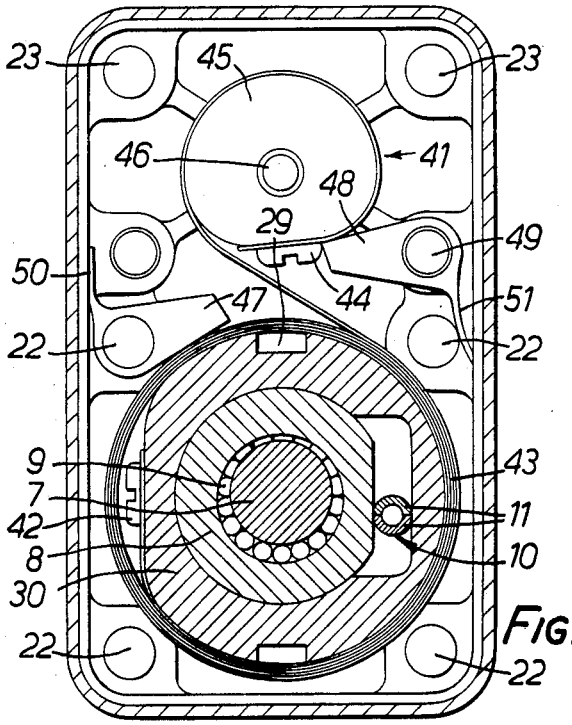
FIG. 6 is a transverse section, similar to FIG. 3, of a second modified recline unit.

It is, alternatively, possible to install the recline unit 6 so that its line of action lies above the back rest pivot axis 4 by either reversing the direction of the lever 5 and mounting the end fitting 12 to the top end of the lever or by mounting the end fitting direct to the back rest 2 above its pivot axis. As will be realized contrary to before, when the back rest 2 is reclined the recline unit will be extended and vice versa. The only modification needed to the recline unit 6 is, as is shown in FIG. 6, to alter the mounting of the torsion spring 43 so that it is led off the storage bobbin 45 in an anti-clockwise sense and on to the drive output roller 30 in a clockwise sense.

The ability of the recline unit 6, by reversing the mounting of the torsion spring 43 as discussed, to work equally effectively in either the tension or the compression mode is a significant advantage so far as potential seat installation is concerned.

The recline unit 6 could alternatively be installed with the end fitting 12 mounted to the seat base 3 and with the end fitting 18 mounted to the bottom or top end of the lever 5 or direct to the back rest 2 above its pivot axis 4 depending upon whether the line of action is to lie below or above the pivot axis.

The combination of the constant torque spring 43 with the high efficiency recirculating ball screw 7 and nut 8 enables the recline unit 6 to be designed with a compact length and to give a constant load output substantially equating with the external force required to operate the unit in the reverse sense.

The recline unit 6 could be used to control the inclination of the back rest of an aircraft seat which could be an aircraft passenger or an aircrew seat, but is not limited thereto and has other applications such as, for example, seats in long distance coaches.

I claim:

1. A recline unit for the inclinable back rest of a seat, comprising a cooperating screw and nut means, mounting means for mounting the cooperating screw and nut means between the back rest and a fixed part of the seat so that the recline unit is interposed as a strut therebetween, the cooperating screw and nut means when so mounted being responsive to the back rest being inclined such that relative axial movement occurs between the cooperating screw and nut means so varying the length of the strut in accordance with the inclination of the back rest with attendant relative rotational movement between the cooperating screw and nut means, and torsion spring means strained in response to the cooperating screw and nut means making said relative rotational movement and operative to effect reverse relative rotational movement between the cooperating screw and nut means with attendant reverse relative axial movement thereof to cause opposite variation in the length of the strut and so return the back rest to a lesser inclination.

2. A recline unit as claimed in claim 1, wherein said mounting means comprise first mounting means for mounting the screw means to one of the back rest and the fixed part of the seat and second mounting means for mounting the nut means to the other of the back rest and the fixed part of the seat, the screw means when so mounted by the first mounting means being restrained against rotation about the axis of the screw means, and the nut means when so mounted by the second mounting means being restrained against axial movement but being free to rotate about the axis of the nut means, the screw means when so mounted being responsive to the back rest being inclined to move axially in one direction relative to the nut means thereby to cause the nut means to rotate about its axis,the torsion spring means being strained in response to said rotation of the nut means and operative to effect rotation of the nut means in the opposite sense thereby to cause the screw means to move axially in the opposite direction so returning the back rest to a lesser inclination.

3. A recline unit as claimed in claim 2, wherein the torsion spring means can be optionally mounted so as to be strained in response to rotation of the nut means caused by the screw means moving axially, upon inclination of the back rest, either in a direction such that the length of the strut contracts or in the opposite direction such that the length of the strut increases by which the recline unit can be mounted to the seat so that its line of action either lies below or above, respectively, a pivot axis about which the back rest can be reclined.

4. A recline unit as claimed in claim 3, including a locking means for operation by an occupant of the seat to lock the cooperating screw and nut means against relative rotation when the back rest is in the required inclination and which can be unlocked so that the cooperating screw and nut means can make relative rotation either in response to the back rest being inclined or when the back rest is returned by the torsion spring means to a lesser inclination.

5. A recline unit as claimed in claim 4, wherein the locking means is spring biased into a locking position at which to lock the cooperating screw and nut means against relative rotation, and wherein the locking means can be urged against the spring bias out of the locking position, so that the cooperating screw and nut means can make relative rotation, under the control of the occupant of the seat.

6. A recline unit as claimed in claim 5, wherein the locking means comprises a locking pin and means biasing the locking pin axially into the locking position, and wherein a bell crank lever is provided which is operable under the control of the occupant of the seat to urge the locking means out of the locking position against the force of the biasing means.

7. A recline unit as claimed in claim 6, including a cable having one end operably attached to the bell crank lever and, in use, the opposite end connected to a push button operable by the occupant of the seat by which operation of the push button causes the cable to pivot the bell crank lever to urge the locking means out of the locking position.

8. A recline unit as claimed in claim 6, including a drive output roller rotationally fast with the nut means and having slot means in its periphery engaged by the locking pin when urged by the biasing means into the locking position to lock the nut means against rotation.

9. A recline unit as claimed in claim 8, wherein the torsion spring means is fixed at one end to the drive output roller and fixed at the opposite end to a storage bobbin from which it is drawn off and strained when the nut means rotates upon the back rest being inclined and around which the torsion spring means returns when effecting rotation of the nut means to return the back rest to the lesser inclination.

10. A recline unit as claimed in claim 9, wherein the slot means comprise two diametrically opposed slots in the periphery of the drive output roller so giving two locking positions for each rotation of the nut means.

11. A recline unit as claimed in claim 10, wherein each slot is a groove whose width is just sufficient to accommodate the locking pin.

12. A recline unit as claimed in claim 10, wherein each slot has a shoulder on one side engageable by the locking pin to lock the cooperating screw and nut means against relative rotation such as otherwise would be caused upon pressure being applied to the back rest to incline it, the opposite side of each slot being cutaway so that the back rest can be pushed manually into a lesser inclination in the event of a failure in the means effecting the reverse relative rotation movement between the cooperating screw and nut means.

13. A recline unit as claimed in claim 9, including pawl means preventing further rotation of the drive output roller and the storage bobbin at the extremes of travel of the torsion spring means.

14. A recline unit as claimed in claim 2, wherein the first mounting means is a first end fitting secured to the screw means, the nut means is mounted for rotation by first bearing means and is restrained against axial movement by second thrust bearing means, the second mounting means is a second end fitting mounting the first bearing means, and the second end fitting forms part of a housing mounting the second thrust bearing means.

15. A recline unit as claimed in claim 1, wherein the torsion spring means is a constant torque spring.

16. A recline unit as claimed in claim 1, wherein the cooperating screw and nut means is a high efficiency recirculating ball screw and nut.

17. A recline unit for the inclinable back rest of a seat, comprising a cooperative screw and nut means, mounting means for mounting the cooperating screw and nut means between the back rest and a fixed part of the seat so that the recline unit is interposed as a strut therebetween, the cooperating screw and nut means when so mounted being responsive to the back rest being inclined such that relative axial movement occurs between the cooperating screw and nut means so varying the length of the strut in accordance with the inclination of the back rest with attendant relative rotational movement between the cooperating screw and nut means, and torsion spring means strained in response to the cooperating screw and nut means making said relative rotational movement between the cooperating screw and nut means with attendant reverse relative axial movement thereof to cause opposite variation in the length of the strut and so return the back rest to a lesser inclination, wherein said mounting means comprises first mounting means for mounting the screw means to one of the back rests and the fixed part of the seat and second mounting means for mounting the nut means to the other of the back rests and the fixed part of the seat, the screw means when so mounted by the first mounting means being restrained against rotation about the axis of the screw means, and the nut means when so mounted by the second mounting means being restrained against axial movement but being free to rotate about the axis of the nut means, the screw means when so mounted being responsive to the back rest being inclined to move axially in one direction relative to the nut means thereby to cause the nut means to rotate about its axis, the torsion spring means being strained in response to said rotation of the nut means and operative to effect rotation of the nut means in the opposite sense thereby to cause the screw means to move axially in the opposite direction so returning the back rest to a lesser inclination, wherein the torsion spring means is a constant torque spring and wherein the cooperating screw and nut means is a high efficiency recirculating ball screw and nut.

* * * * *